US005188659A

United States Patent [19]

Purnell

[11] Patent Number: 5,188,659

[45] Date of Patent: Feb. 23, 1993

[54] SINTERED MATERIALS AND METHOD THEREOF

[75] Inventor: Charles G. Purnell, Coventry, England

[73] Assignee: Brico Engineering Limited, Coventry, England

[21] Appl. No.: 567,766

[22] Filed: Aug. 15, 1990

[30] Foreign Application Priority Data

Sep. 20, 1989 [GB] United Kingdom ..... 8921260

[51] Int. Cl.[5] ..... B22F 9/00; C22C 38/24

[52] U.S. Cl. ..... 75/246; 148/334; 419/2; 419/6

[58] Field of Search ..... 419/2, 6, 10; 75/246; 420/111; 148/334

[56] References Cited

U.S. PATENT DOCUMENTS 4,485,147 11/1984 Nishino et al. ..... 419/2
4,933,008 6/1990 Fujiki et al. ..... 75/246

FOREIGN PATENT DOCUMENTS 0312161 4/1989 European Pat. Off. .
2292543 6/1976 France .
57-158357 9/1982 Japan ..... 75/246
61-084355 4/1986 Japan .
8803961 6/1988 PCT Int'l Appl. .
1504547 3/1978 United Kingdom .

OTHER PUBLICATIONS

Metall, vol. 38, No. 4, Apr. 1984, pp. 295-300; Nissel et al, "Die heissisostatische Presstechnik (HIP)-Teil VII". Patent Abstracts of Japan, vol. 5, No. 189(M-99), Nov. 28, 1981; JP 56-108803(a), Tokyo Shibaura Denki K.K.; Aug. 28, 1981, English translation of JP 57-158357.

*Primary Examiner*—Deborah Yee
*Attorney, Agent, or Firm*—William R. Hinds

[57] ABSTRACT

Sintered materials and a method are described for the production of ferrous articles, particularly valve seat inserts. The materials are based on A1S1 H11, H12 and H13 materials plus diluent material.

13 Claims, 1 Drawing Sheet

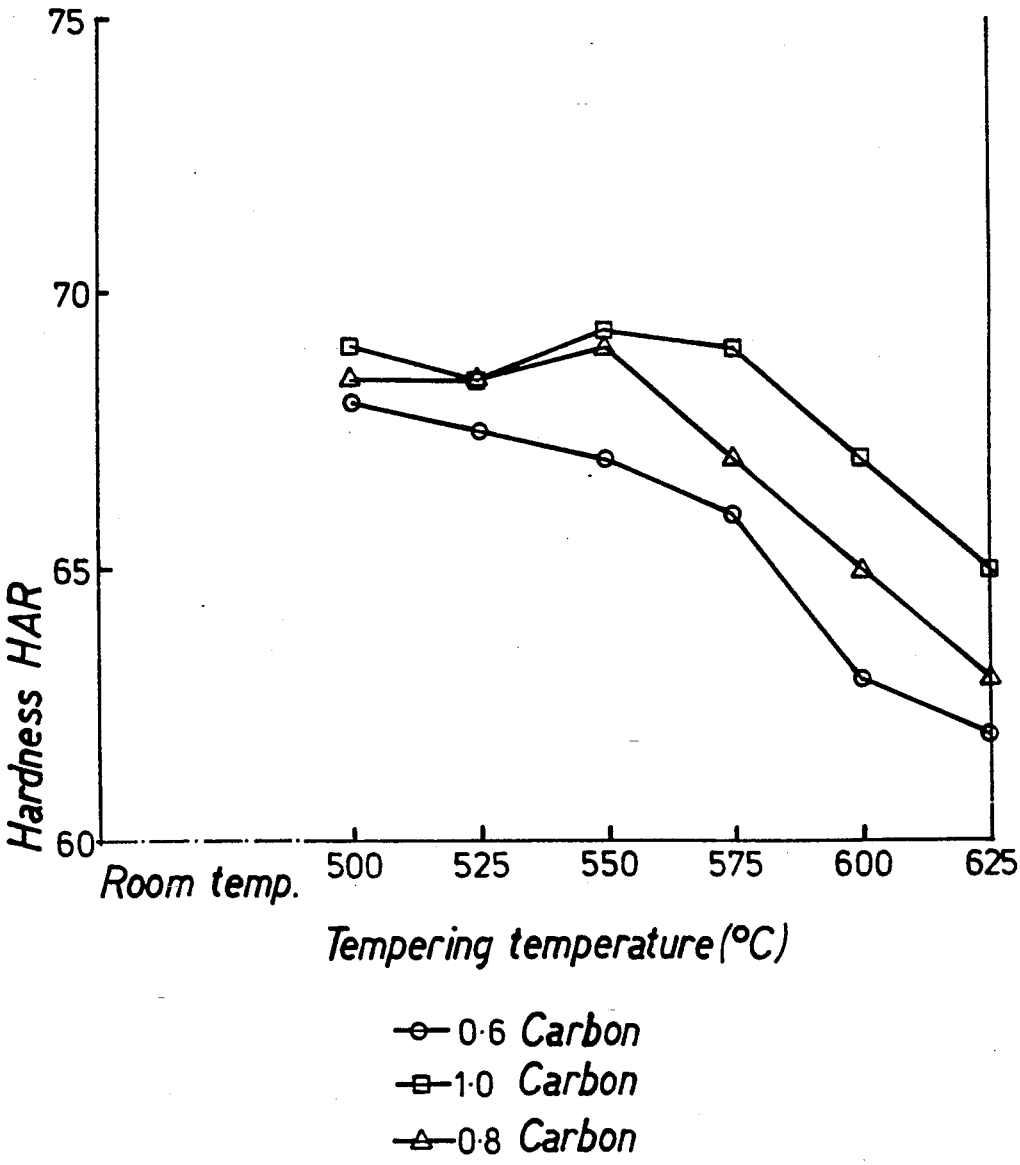
75
70
65
60
Hardness HAR
Room temp.
500
525
550
575
600
625
Tempering temperature (°C)
0·6 Carbon
1·0 Carbon
0·8 Carbon

SINTERED MATERIALS AND METHOD THEREOF

The present invention relates to sintered ferrous materials, particularly, though not exclusively for use as valve seat inserts for internal combustion engines.

Tool steels are conventionally classified as cold work, hot work, or high speed steels, depending upon the type and level of their alloy constituents, their resistance to thermal softening, and their intended use in cold or hot wear applications. In general the levels of the more expensive elements conferring hot wear resistance increases through the sequence, with high speed steels being the most highly alloyed.

It is known to use sintered and infiltrated high speed steels for the production of valve seat inserts for internal combustion engines. One such known material has the composition in weight % of: C 0.6–1.5/W 4–6/Mo 4–6/V 2–3/Cr 2.5–4/Cu 15–25/others 2 max./Fe balance, the material being infiltrated. Such alloys are costly because of the high levels of alloying additions and also abrasive to the co-operating valve seating face which may require to be coated with an alloy such as Stellite (trade mark), for example, particularly against the valve seat insert in the exhaust position.

Generally, components are pressed from a pre-alloyed powder, and then sintered and infiltrated with a copper base alloy simultaneously or sintered and infiltrated as separate operations, at temperatures in the region of 1100° C., to give good dimensional control over the sintered product. The highly alloyed powder results in low compressibility and high pressing pressures are needed to produce relatively high green densities, with attendant added costs on dies and pressing equipment due to high wear rates. Pressures of more than 60 tsi (930 MPa) are not normally used.

British patent application GB 2 210 895 describes the use of high speed steels diluted with an unalloyed or low alloy iron powder which also has a low carbon content, the desired carbon level being produced by additions of free graphite in the powder mixture. Such materials allow relatively high green densities to be achieved at relatively low pressing pressures.

We have now found that hot working tool steels, as distinct from high-speed steels may be used as a suitable basis, either alone or diluted with iron powder, for the production of valve seat inserts for internal combustion engines, particularly advantageously in the exhaust position.

According to a first aspect of the present invention there is provided a sintered ferrous material having a composition expressed in weight % lying within the ranges: C 0.7–1.3/Si 0.3–1.3/Cr 1.9–5.3/Mo 0.5–1.8/V 0.1–1.5/Mn 0.6 max/Fe balance apart from incidental impurities.

Preferably the alloy microstructure comprises a tempered martensitic matrix containing fine spheroidal alloy carbides. Bainite and a minor proportion of ferrite may also be present.

Suitable steels may be those known under the American Iron and Steel Institute (AISI) codes H11, H12 and H13, which in ingot form have a low, stochiometrically deficient carbon level and which show, with a carbon addition, unexpectedly good hot wear resistance and resistance to thermal softening. Green densities in excess of 85% of theoretical density may be achieved with pressing pressures as low as 50 t.s.i. (770 MPa). The good hot wear and thermal softening resistance results in part from the fact that sintered compacts of blends with higher carbon contents than found in the original steel powder exhibit a marked secondary hardening effect and resistance to thermal softening, which is not a characteristic of compacts of blends of the basis steel powder at its original carbon content. This additional resistance to thermal softening survives, in mixes of the hot work steel powder with an approximately equal proportion of iron or low-alloy iron powder, plus additions of copper and graphite powders, giving a carbon content of approximately 1 wt. %, better than in the basis tool steel.

According to a second aspect of the present invention a method of making a valve seat insert comprises the steps of mixing a hot working tool steel powder of composition C 0.3–0.7/Si 0.8–1.20/Cr 4.5–5.5/Mo 1.2–1.8/V 0.3–1.5/Mn 0.1–0.6/Fe balance with graphite powder and up to 60 wt % of a diluent iron or low-alloy iron powder to give a composition lying within the range of the first aspect, pressing a valve seat insert and sintering the green pressing. The micro structure of the undiluted material comprises a tempered martensitic matrix containing both intra- and inter-granular fine alloy carbides, which advantageously however, are present at a much reduced volume fraction of the material compared to the volume fraction in prior art materials based on high speed steels. It has been found that materials of the present invention are less abrasive to the co-operating valve seat face than prior art alloys based on high speed steels.

In the diluted material the micro structure comprises a reticular structure of the same martensitic matrix as in the undiluted material, with intermediate transition regions, mainly of pearlite and bainite, some ferrite may be present. The maximum dilution of 60 wt % with iron powder is chosen because at greater dilutions the proof stress of the resulting material will be inadequate for the loads imposed in service at the elevated temperatures reached by exhaust valve seat inserts in some applications.

The material may optionally contain from 1–6 wt. % of copper added in the form of powder to the mixture as a sintering aid. The material may optionally contain up to 1.0 wt. % sulphur as an aid to machinability. Sulphur may, for example, be added as elemental sulphur or pre-alloyed into the ferrous powder.

The material may further comprise additions of up to 5 wt. % of metallic sulphides which may include, for example, molybdenum disulphide or manganese sulphides. Such additions may be made for their beneficial effect on wear resistance, solid lubrication and machinability. Additions may be made at the powder blending stage but, however, the resulting sintered material will comprise a complex sulphide structure owing to diffusion effects between constituents during sintering.

Preferably, alloys of the present invention may be compacted to green densities in excess of 85% of theoretical density.

Materials of the present invention may optionally be infiltrated with a copper base alloy. Such infiltration may be successfully accomplished at compacted densities substantially greater than 85% of theoretical although this is conditional on the presence of interconnected porosity. Lower densities may of course be infiltrated. Where the material is infiltrated, an addition of 1–6 wt. % of copper powder to the mix may be omitted.

Sintering and infiltration steps may be carried out either consecutively or simultaneously.

The iron powder diluent may be substantially pure iron powder containing only those impurities normally associated with and found in iron powder. Preferably, the iron powder may contain up to 0.5 wt % total alloying additions for improving hardenability. More preferably, these alloying additions may comprise manganese; the effect of this on the microstructure is to limit the proportion of ferrite which appears, which limitation is beneficial to wear resistance.

Free carbon is employed in the powder mixture also to generate wear resistant, hard carbide phases such as bainite, for example, in the non-tool steel regions of the microstructure where dilution with iron powder is used.

It has been found that valve seat inserts for internal combustion engines made from the material and by the method of the present invention may be used in conjunction with valves having unfaced seatings. Valves having seatings faced with Stellite (trade mark), for example, may of course be used.

The articles made by the method of the invention may optionally be thermally processed after sintering. Such thermal processing may comprise a cryogenic treatment in, for example, liquid nitrogen followed by a tempering heat treatment in the range 500°-650° C. Following such heat treatment the alloy matrix comprises tempered martensite with spheroidised alloy carbides. Bainite, pearlite and occasional ferritic regions may also be present. The porosity of infiltrated material is essentially filled with copper based alloy.

In order that the present invention may be more fully understood, examples will now be described by way of illustration only.

EXAMPLE 1

A ferrous powder having a composition within the ranges C 0.3-0.5/Si 0.8-1.2/Mn 0.1-0.5/Cr 4.5-5.5/Mo 1.2-1.8/V 0.9-1.5/others 1.0 max./, was mixed with 4.0 wt. % of −300 B.S. mesh copper powder and graphite powder intended to achieve a final carbon content of 1.0 wt. %. To this was added 1.0 wt. % of a lubricant wax to act as a pressing and die lubricant. The powders were mixed for 30 minutes in a Y-cone rotating mixer. Valve seat inserts were then pressed using double-sided pressing at a pressure of 50 tsi (770 MPa). The pressed green bodies were then sintered in a hydrogen and nitrogen atmosphere at 1100° C. for 30 minutes. The resulting inserts had a composition of C 1.10/Cr 5.0/Mn 0.28/Mo 1.49/Si 0.93/V 0.93/Cu 4.0/Fe plus impurities balance. These articles were cryogenically treated for 20 minutes at −120° C. and samples were tempered at 585° C. for 2 hours.

EXAMPLE 2

A ferrous powder having a composition within the ranges C 0.3-0.5/Si 0.8-1.2/Mn 0.1-0.5/Cr 4.5-5.5/Mo 1.2-1.8/V 0.9-1.5/others 1.0 max./was mixed with 4.0 wt. % of −300 mesh copper powder and graphite powder intended to achieve a final carbon content of 0.7 wt. %. To this was added 1.0 wt % of a lubricant wax to act as a pressing and die lubricant. This powder was subsequently processed from the mixing stage as in Example 1, above.

The measured Rockwell hardness, (HRA), of samples tempered at different temperatures, from Examples 1 and 2 above, showed that thermal softening, revealed by a decrease in Rockwell hardness with increasing tempering temperature, started some 50° C. higher for material from Example 1 compared with material from Example 2 due to the higher carbon content.

Hot-hardness data for samples from Examples 1 and 2, tempered for 2 hours at the same temperature, are shown in Table 1 below.

TABLE 1

| | Hot-hardness (HR30N) Temperature (°C.) | | |
|---|---|---|---|
| | RT | 300 | 500 |
| Example 1 | 65 | 62 | 51 |
| Example 2 | 59 | 56 | 48 |

The graph in the FIGURE shows the tempering curves at three different carbon levels for the undiluted, uninfiltrated sintered material having, apart from the carbon levels, the same composition as described in Examples 1 and 2.

EXAMPLE 3

A ferrous powder having a composition within the ranges C 0.3-0.5/Si 0.8-1.2/Mn 0.1-0.5/Cr 4.5-5.5/Mo 1.2-1.8/V 0.9-1.5/others 1.0 max., was mixed with an equal portion of Atomet 1001 (trade mark) iron powder and graphite powder intended to achieve a final carbon content of 1.0 wt %. To this was added 1.0 wt % of a lubricant wax to act as a pressing and die lubricant. The powders were mixed for 30 minutes in a Y-cone rotating mixer. Valve seat inserts were then pressed using double-sided pressing at a pressure of 50 tsi (770 MPa).

The pressed green bodies were then stacked with pressed compacts of a copper infiltrant powder each weighing 20 wt % of the weight of the green body. The articles were then simultaneously sintered and infiltrated in a hydrogen and nitrogen atmosphere at 1100° C. for 30 minutes. The resulting inserts had a composition of C 0.91/Si 0.52/Mn 0.33/Cr 2.09/Mo 0.61/V 0.43/Cu 12.6/impurities plus Fe balance. These inserts were then cryogenically treated for 20 minutes at −120° C., and samples were finally tempered in air at 575° C. for 2 hours.

EXAMPLE 4

A ferrous powder having a composition within the ranges C 0.3-0.5/Si 0.8-1.2/Mn 0.1-0.5/Cr 4.5-5.5/Mo 1.2-1.8./V 0.9-1.5/others 1.0 max. was mixed with graphite powder intended to achieve a final carbon content of 1.0 wt %. To this was added 1.0 wt % of a lubricant wax to act as a pressing and die lubricant. The powders were then processed into valve seat inserts as for Example 3.

The pressed green bodies were then stacked with pressed compacts of a copper infiltrant powder, each weighing 20% of the weight of the green body. The articles were then simultaneously sintered and infiltrated in a hydrogen and nitrogen atmosphere at 1100° C. for 30 minutes. These articles were cryogenically treated for 20 minutes at −120° C., and samples finally tempered in air at 575° C. for 2 hours.

Mechanical property data for samples from Examples 3 and 4 above are shown in Tables 2, 3 and 4 below, whilst Table 5 shows the thermal conductivity of the materials at various temperature.

TABLE 2

| | Hot-hardness (HR30N) Temperature (°C.) | | |
|---|---|---|---|
| | RT | 300 | 500 |
| Example 3 | 63 | 56 | 49 |
| Example 4 | 71 | 68 | 58 |

TABLE 3

| | Youngs Modulus (GPa) Temperature (°C.) | | |
|---|---|---|---|
| | RT | 300 | 500 |
| Example 3 | 190 | 170 | 140 |
| Example 4 | 190 | 180 | 160 |

TABLE 4

| | 0.2% Proof Stress (MPa) Temperature (°C.) | | |
|---|---|---|---|
| | RT | 300 | 500 |
| Example 3 | 1300 | 1100 | 850 |
| Example 4 | 1800 | 1500 | 1250 |

TABLE 5

| | Thermal Conductivity (W/m/°K.) Temperature (°C.) | | |
|---|---|---|---|
| | RT | 300 | 500 |
| Example 3 | 36 | 38 | 38 |
| Example 4 | 30 | 33 | 36 |

Machined valve seat inserts made by the methods used for Examples 3 and 4, above, were fitted into the exhaust positions of Cylinder 2, and Cylinders 1 and 3, respectively, of a 1.8 liter, four cylinder automotive engine. A valve seat insert of a non-infiltrated material was fitted in Cylinder 4 for comparison. The engine was run continuously for 180 hours at 6000 rpm. at full load on unleaded gasoline.

At the completion of the test the wear on both the valve seat inserts and the valves was measured. The results are set out in Table 6 below which shows the combined valve/valve seat wear (μm), after 180 hours endurance test at 6000 rpm.

TABLE 6

| Cylinder Number | Combined wear |
|---|---|
| 1. (Example 4) | 25 |
| 2. (Example 3) | 53 |
| 3. (Example 4) | 13 |
| 4. Non-infiltrated material. | 193 |

The engine manufacturer's specification for such a test is that combined valve/valve seat wear should not exceed 300 μm.

Machined valve seat inserts made by the method used for Example 4, above, were fitted in both inlet and exhaust positions in a turbocharged IDI automotive diesel engine alongside Original Equipment valve seat inserts based on high speed steel powders. The engine was run for 100 hours according to an endurance cycle, with a maximum speed of 4300 rpm. at full load.

At the completion of the test the wear on the valve seat inserts and valves was measured. The wear results for material from Example 4 are compared with Original Equipment valve seat inserts in Table 7 below which shows the average combined valve/valve seat insert wear after 100 hours cyclic endurance test (μm).

TABLE 7

| Inlet | | Exhaust | |
|---|---|---|---|
| Material | Wear (μm) | Material | Wear (μm) |
| Example 4 | 90 | Example 4 | 45 |
| OE Material | 80 | OE Material | 80 |

I claim:

1. A sintered ferrous material, the material having a composition expressed in weight % lying within the ranges: C 0.7–1.3/Si 0.3–1.3/Cr 1.9–5.3/Mo 0.5–1.8/V 0.1–1.5/Mn 0.6max/Fe balance apart from incidental impurities, and having a microstructure comprising a tempered martensitic matrix containing fine spheroidal alloy carbides.

2. A material according to claim 1 also having from 1 to 6 wt % of copper.

3. A material according to claim 1 also having up to 1.0 wt % of sulphur.

4. A material according to claim 1 also having up to 5 wt % of metallic sulphide.

5. A method of making a valve seat insert, the method comprising the steps of mixing a hot working tool steel powder of composition C 0.3–0.7/Si 0.8–1.20/Cr 4.5–5.5/Mo 1.2–1.8/V 0.3–1.5/Mn 0.1–0.6/Fe balance with graphite powder and up to 60 wt % of iron or low-alloy iron powder to give a composition according to claim 1, pressing a valve seat insert and sintering the green pressing.

6. A method according to claim 5 further including the step of mixing in from 1 to 6 wt. % of copper.

7. A method according to claim 5 further including the step of mixing in up to 1.0 wt. % of sulphur.

8. A method according to claim 5 further including the step of mixing in up to 5 wt. % of metallic sulphide.

9. A method according to claim 5 further including the step of infiltrating the valve seat insert with a copper based material.

10. A method according to claim 5 further including the step of giving the valve seat insert a cryogenic treatment.

11. A valve seat insert having a composition according to claim 1.

12. A valve seat insert when made by the method of claim 5.

13. A sintered ferrous material according to claim 1 having an as-pressed density of 85% of theoretical density or greater.

* * * * *